US006547540B1

(12) United States Patent
Horng et al.

(10) Patent No.: US 6,547,540 B1
(45) Date of Patent: Apr. 15, 2003

(54) SUPERCHARGING STRUCTURE FOR A FAN

(75) Inventors: Alex Horng, Kaohsiung (TW); Ching-Shen Hong, Kaohsiung (TW); Ching-Lin Wu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 09/964,346

(22) Filed: Sep. 28, 2001

(51) Int. Cl.[7] ..... F04B 17/03

(52) U.S. Cl. ..... 417/423.14; 417/423.5; 417/423.8; 417/424.1; 415/211.2; 415/208.2; 361/695; 361/697

(58) Field of Search ..... 415/211.2, 208.2, 415/213.1, 214.1, 175, 176, 177, 178; 417/423.5, 423.8, 423.14, 424.1; 361/695, 697

(56) References Cited

U.S. PATENT DOCUMENTS 4,080,096 A * 3/1978 Dawson ..... 415/208.2
6,017,185 A * 1/2000 Kuo ..... 165/121
6,244,818 B1 6/2001 Chang ..... 415/208.2
6,386,276 B1 * 5/2002 Chen et al. ..... 165/121
6,388,880 B1 * 5/2002 El-Ghobashy et al. . 165/104.33
6,407,919 B1 * 6/2002 Chou ..... 361/697
2002/0018336 A1 * 2/2002 Liang et al. ..... 361/697
2002/0060900 A1 * 5/2002 Qiu ..... 361/683

* cited by examiner

*Primary Examiner*—Timothy S. Thorpe
*Assistant Examiner*—Emmanuel Sayoc
(74) *Attorney, Agent, or Firm*—Bacon & Thomas, PLLC

(57) ABSTRACT

A fan having a supercharging structure includes a casing having an air passage hole with an air inlet at a first end thereof and an air outlet at a second end thereof. A base is mounted to the air outlet end of the casing. A supporting plate is mounted in the air passage hole of the casing or an air outlet in the base for engaging with a stator bobbin that pivotally holds a fan wheel to be driven. Plural supercharging plates are mounted between the supporting plate and the base.

7 Claims, 11 Drawing Sheets

SUPERCHARGING STRUCTURE FOR A FAN

BACKGROUND OF THE INVENTION

1. Field of the Invention

The present invention relates to a supercharging structure for a fan, wherein the thickness of the casing of the fan can be varied in response to a change in the height of the fan wheel while providing an airflow driven by the axial flow fan with a relatively high blast pressure on the air outlet side.

2. Description of the Related Art

U.S. Pat. No. 6,244,818 to Chang issued on Jun. 12, 2001 discloses a fan guard structure for additional supercharging function. As illustrated in FIG. 1 of the drawings that corresponds to FIG. 2A of U.S. Pat. No. 6,244,818, the fan guard 90 comprises a motor holder 91 and plural radial guard blades 92. A rotor device is mounted to the motor holder 91 and comprises a motor 93 for driving a shaft ring (fan wheel) 94. When the fan wheel 94 turns, surrounding air is introduced by the rotor blades 95 to generate an airflow which is outputted after passing through gaps between the guard blades 92. The blast pressure is changed from a relatively low value on the air inlet side into a relatively high value on the air outlet side. That is, there is a blast pressure enhancement on the air outlet side.

As illustrated in FIG. 2 that corresponds to FIG. 7 of U.S. Pat. No. 6,244,818, a composite fan comprises two fan units 90 each including guard blades 92 and the rotor device mentioned above, which also fulfills the function of improving performance of the fan.

The fan disclosed in U.S. Pat. No. 6,244,818 has a fixed thickness (or height), as the thickness of the casing 90 and of the fan wheel 94 is fixed. Thus, factories manufacturing the fans must prepare molds for manufacturing casings 90 of various thicknesses. In addition, spare products are required for different needs.

Furthermore, mounting of the motor 93, fan wheel 94, and drive circuit of the rotor device into the casing 90 becomes difficult when the casing 90 is relatively thick. Further, inconvenience was found when mounting the fan disclosed in U.S. Pat. No. 6,244,818 on a heat-dissipating member, which is the most common use of the fan.

SUMMARY OF THE INVENTION

It is, therefore, an object of the present invention to provide a supercharging structure for a fan, wherein the thickness of the casing of the fan can be varied in response to a change in the fan wheel.

Another object of the present invention is to provide a supercharging structure for a fan, wherein the rotor device of the fan can be assembled easily.

A further object of the present invention is to provide a supercharging structure for a fan, wherein the fan can be directly engaged with a heat-dissipating member to thereby form a heat-dissipating unit.

A fan having a supercharging structure comprises a casing having an air passage hole with an air inlet at a first end thereof and an air outlet at a second end thereof. A base is mounted to the air outlet end of the casing. A supporting plate is mounted in the air passage hole of the casing or in an air outlet in the base for engaging with a stator bobbin that pivotally holds a fan wheel to be driven. Plural supercharging plates are mounted between the supporting plate and the base.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
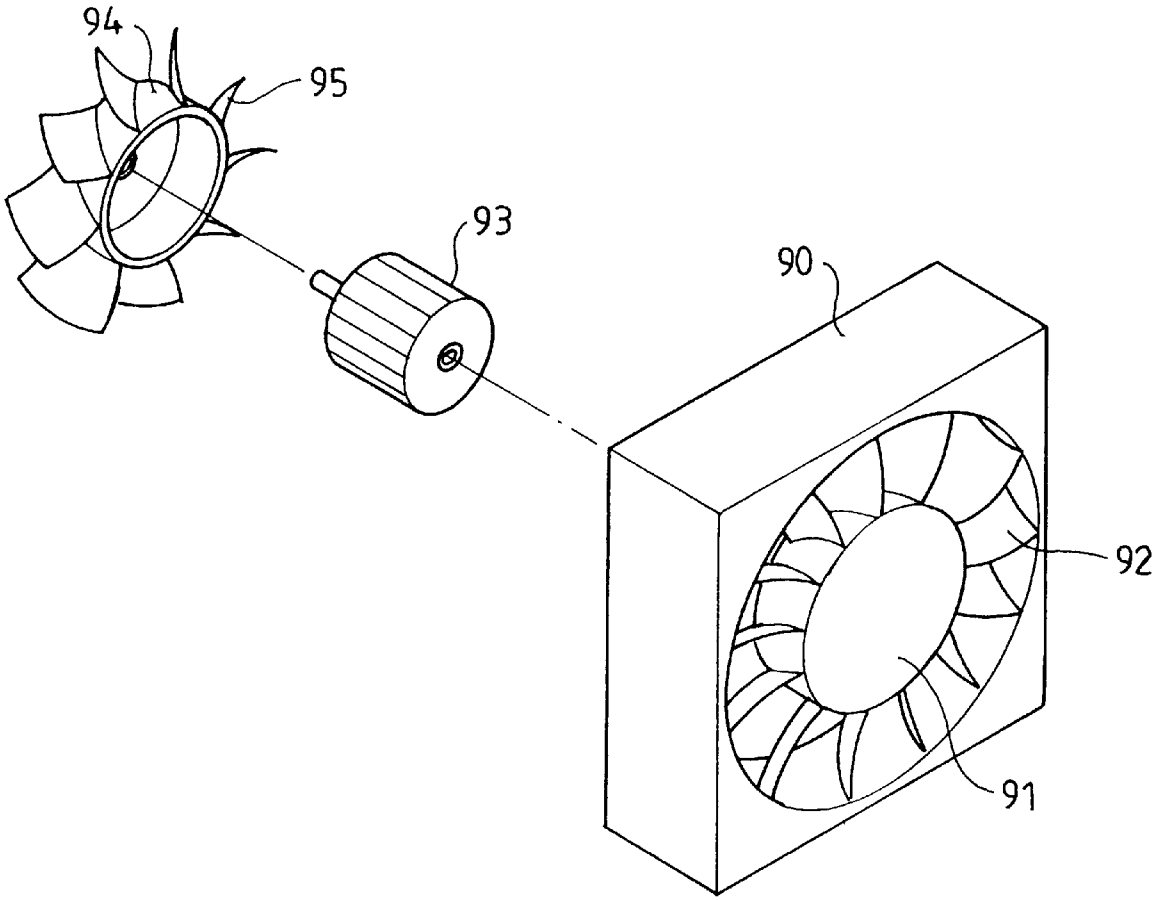
FIG. 1 PRIOR ART
FIG. 1 is an exploded perspective view of a conventional fan disclosed in U.S. Pat. No. 6,244,818.
Figure 2:
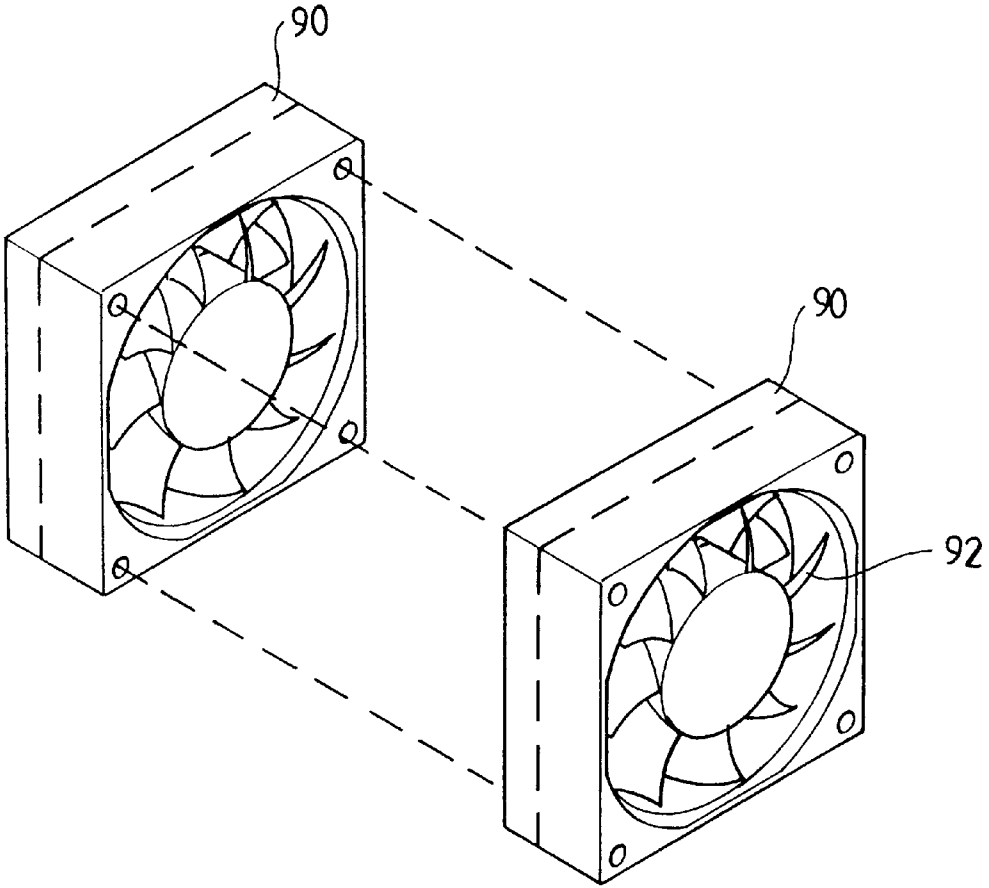
FIG. 2 PRIOR ART
FIG. 2 is an exploded perspective view of a conventional composite fan disclosed in U.S. Pat. No. 6,244,818.
Figure 3:
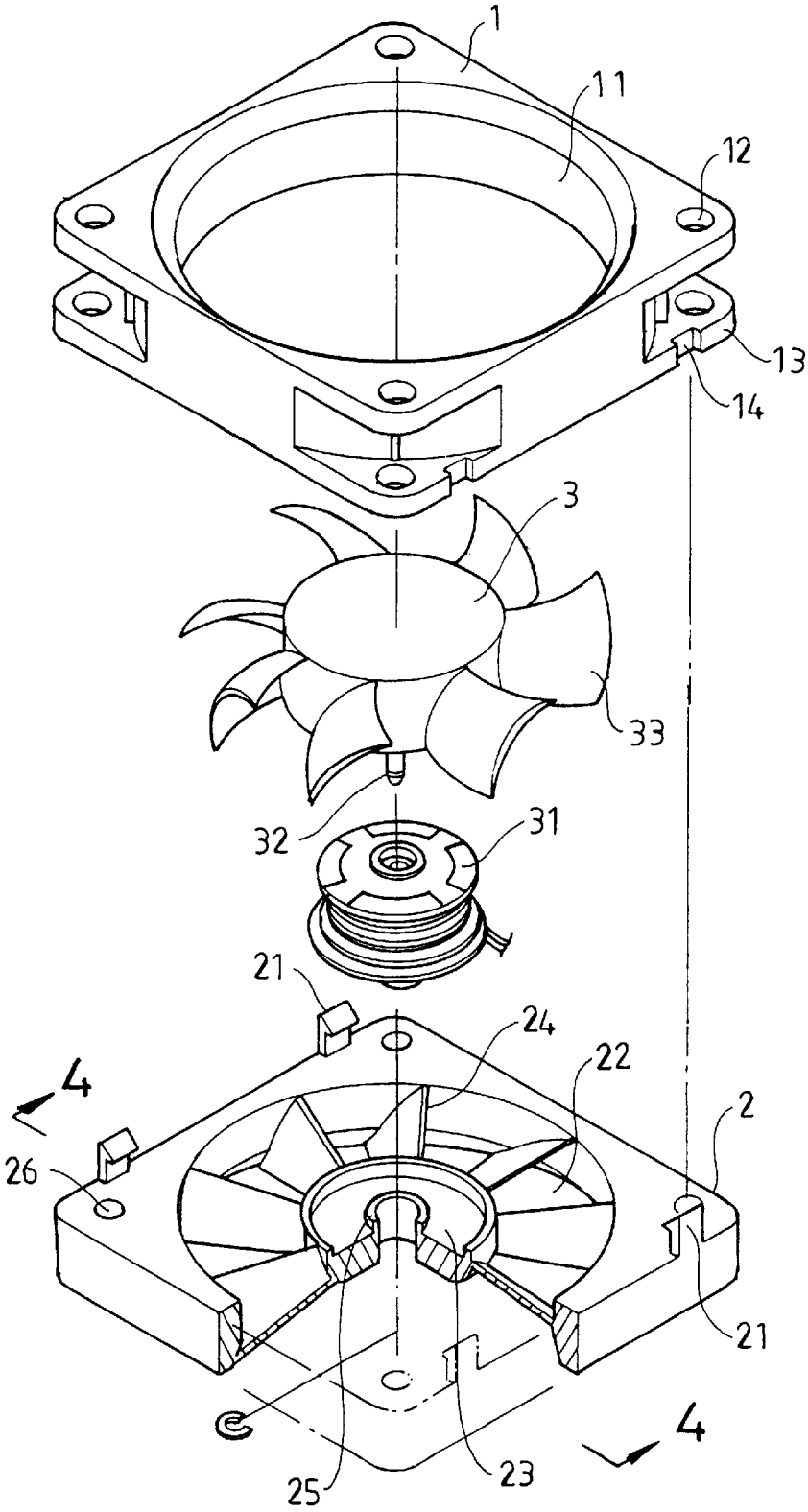
FIG. 3 is an exploded perspective view of a first embodiment of the fan in accordance with the present invention.

Referring to FIG. 3, a first embodiment of the fan in accordance with the present invention generally comprises a casing 1, a base 2, and a fan wheel 3.

The casing 1 may be of any desired height and comprise an air passage hole 11 having an air inlet at an end thereof and an air outlet at the other end thereof. The casing 1 includes holes 12 through which fasteners (such as bolts or the like) extend.

The base 2 is coupled to the air outlet end of the casing 1 and comprises engaging members 21 that include hooks for hooking on opposite edges 13 of the casing 1. In order to prevent exposure of the engaging members 21, each edge 13 includes notches or recesses 14 for receiving the hooks of the engaging members 21 Such that the engaging members 21 are flush with the edges 13 of the casing 1 after assembly, best shown in FIG. 5. The base 2 further comprises an air outlet 22 aligned with the air passage hole 11 of the casing 1. An inner wall of the base 2 defining the air outlet 22 is preferably tapered at one end to form a funnel-shape. A supporting plate 23 is mounted in the air outlet 22 of the base 2, and plural supercharging plates 24 are connected between the supporting plate 23 and the base 2, thereby fixing the supporting plate 23. Each supercharging plate 24 is an incline(d plate or is shaped as an axial flow blade. The inclination direction of the supercharging plates 24 is opposite to that of blades 33 of the fan wheel 3. The supporting plate 23 further comprises an axle seat 25 for engaging with a stator bobbin 31 of the fan wheel 3. Further, holes 26 are defined in the base 2 and aligned with the holes 12 of the casing 1.

The fan wheel 3 comprises a central shaft 32 that is rotatably received in the stator bobbin 31. The blades 33 of the fan wheel 3 may drive the air to flow. The stator bobbin 31 is engaged on the axle seat 25 of the supporting plate 23, as mentioned above.

Figure 4:
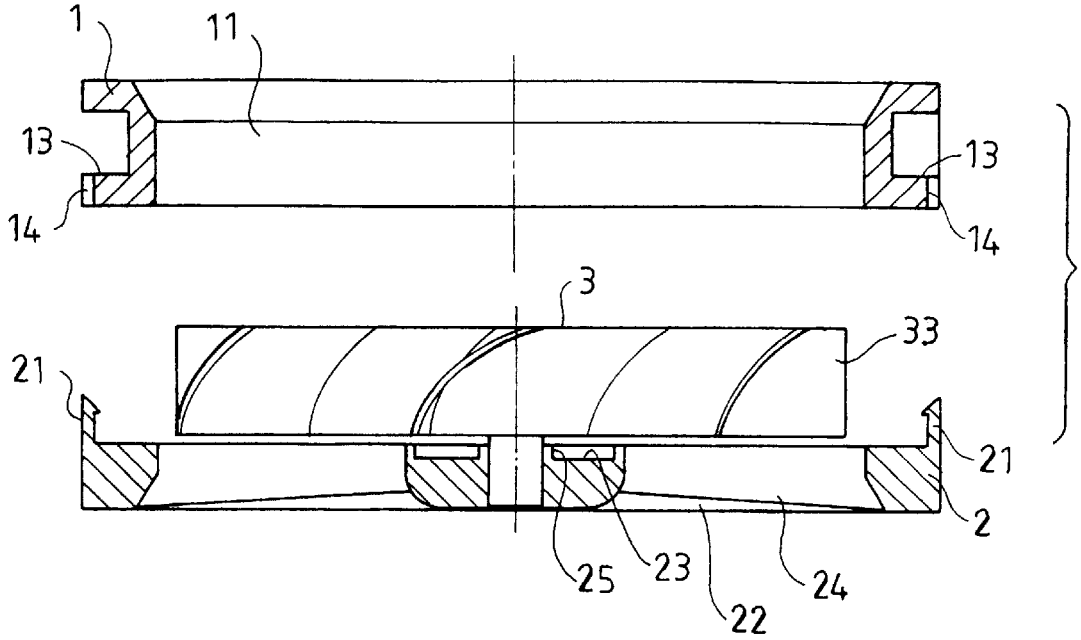
FIG. 4 is a sectional view illustrating assembly of the fan in FIG. 3.
Figure 5:
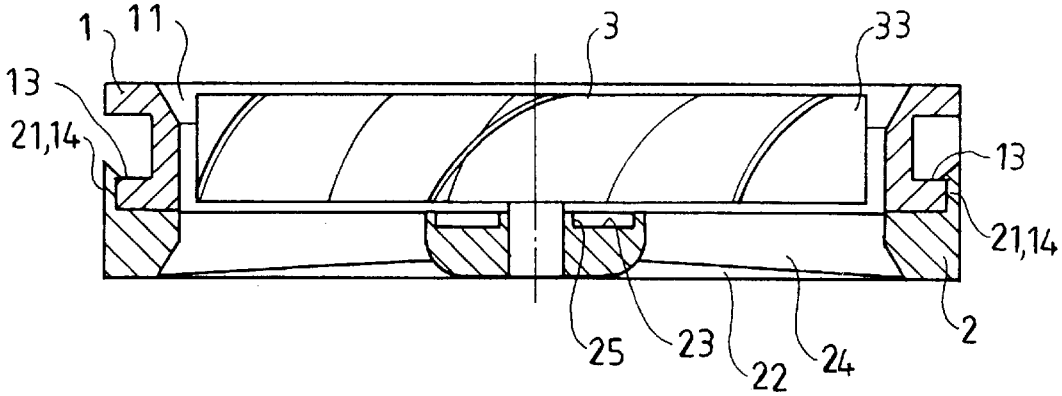
FIG. 5 is a sectional view of the fan in FIG. 3 after assembly.

FIGS. 4 and 5 illustrate assembly procedure of the fan in FIG. 3. The stator bobbin 31 is mounted to the axle seat 25 of the base 2. The central shaft 32 of the fan wheel 3 is then rotatably mounted in the stator bobbin 31. Next, the base 2 is coupled to the casing 1 by the engaging members 21. Since the fan wheel 3 and the stator bobbin 31 are directly mounted on the base 2, the assembly procedure is convenient. In addition, the thickness (or height) of the casing 1 can be selected according to the height of the fan wheel 3. When the fan wheel 3 turns, air is driven by the blades 33 and thus sucked into the air inlet of the air passage hole 11 and then exits the base 2 via the air outlet 22 of the base 2. The blast pressure of the airflow is increased when exiting the air outlet 22 due to provision of the inclined supercharging plates 24.

Figure 6:
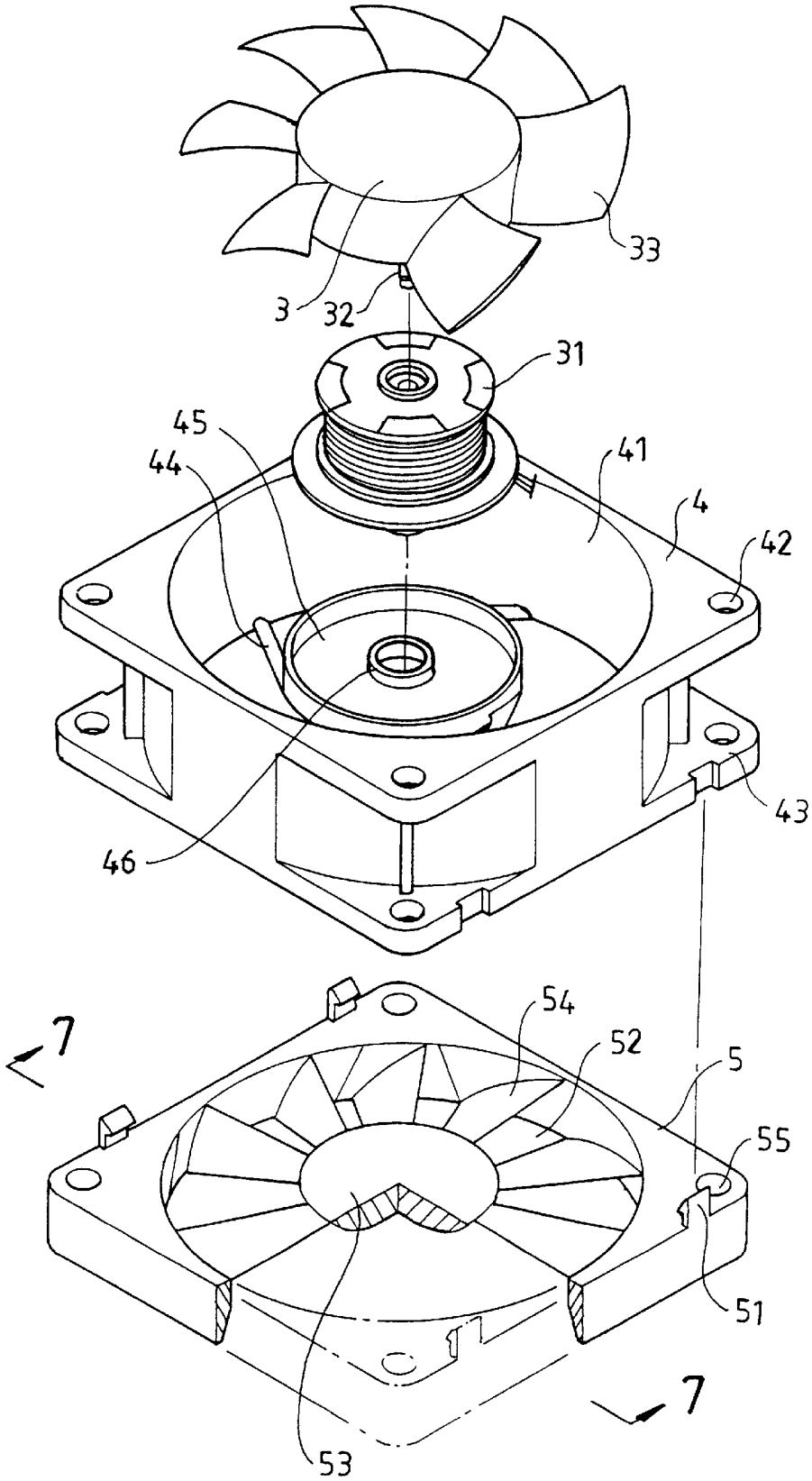
FIG. 6 is an exploded perspective view of a second embodiment of the fan in accordance with the present invention.

Referring to FIG. 6, a second embodiment of the fan in accordance with the present invention generally comprises a casing 4, a base 5, and a fan wheel 3.

The casing 4 comprises an air passage hole 41 having an air inlet at an end thereof and an air outlet at the other end thereof. The casing 4 includes holes 42 through which fasteners (such as bolts or the like) extend. A supporting plate 45 is supported in the air outlet of the air passage hole 41 by a rod 44 and comprises an axle tube 46.

The base 5 is coupled to the air outlet end of the casing 4. In this embodiment, the base 5 comprises engaging members 51 that include hooks for hooking on opposite edges 43 of the casing 4 to thereby provide convenient assembly. The base 5 further comprises an air outlet 52 aligned with the air passage hole 41 of the casing 4. A solid central portion 53 is formed in the air outlet 52 of the base 5, and plural supercharging plates 54 are connected between the solid central portion 53 and the base 5. Each supercharging plate 54 is an inclined plate or has a shape as that of an axial flow blade. The inclination direction of the supercharging plates 54 is opposite to that of blades 33 of the fan wheel 3. Further, holes 55 are defined in the base 5 and aligned with the holes 42 of the casing 4.

The fan wheel 3 comprises a central shaft 32 that is rotatably received in the stator bobbin 31. The blades 33 of the fan wheel 3 may drive the air to flow. The stator bobbin 31 is engaged on the axle tube 46 of the supporting plate 45, as mentioned above.

Figure 8:
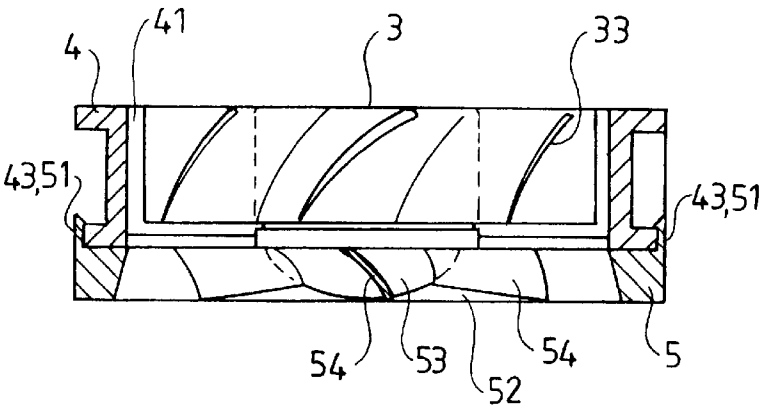
FIG. 8 is a sectional view of the fan in FIG. 6 after assembly.
Figure 7:
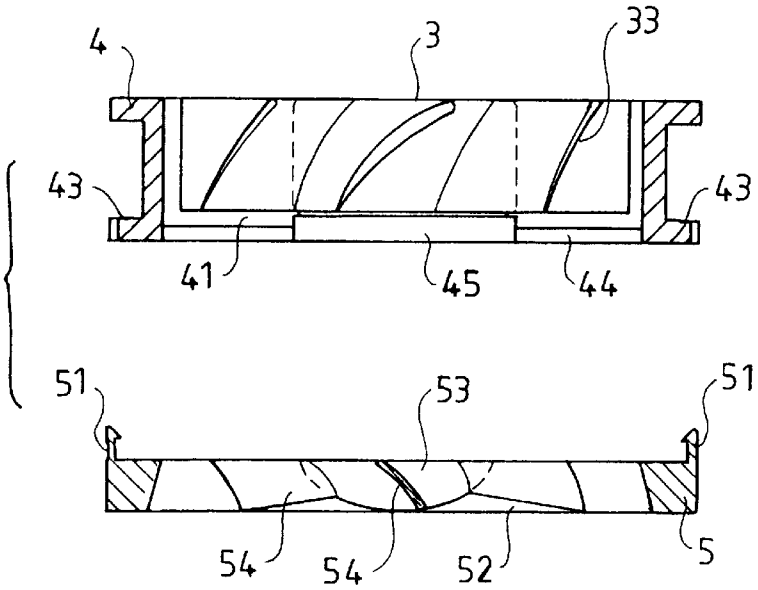
FIG. 7 is a sectional view illustrating assembly of the fan in FIG. 6.

FIGS. 7 and 8 illustrate assembly procedure of the fan in FIG. 6. The stator bobbin 31 is mounted to the axle tube 46 of the base 4. The central shaft 32 of the fan wheel 3 is then rotatably mounted in the stator bobbin 31. Next, the base 5 is coupled to the casing 4 by the engaging members 51. Since the fan wheel 3 and the stator bobbin 31 are directly mounted on the axle tube 46 of the base 4, the assembly procedure is convenient. When the fan wheel 3 turns, air is driven by the blades 33 and thus sucked into the air inlet of the air passage hole 41 and then exits the base 5 via the air outlet 52 of the base 5. The blast pressure of the airflow is increased when exiting the air outlet 52 due to provision of the inclined supercharging plates 54.

Figure 9:
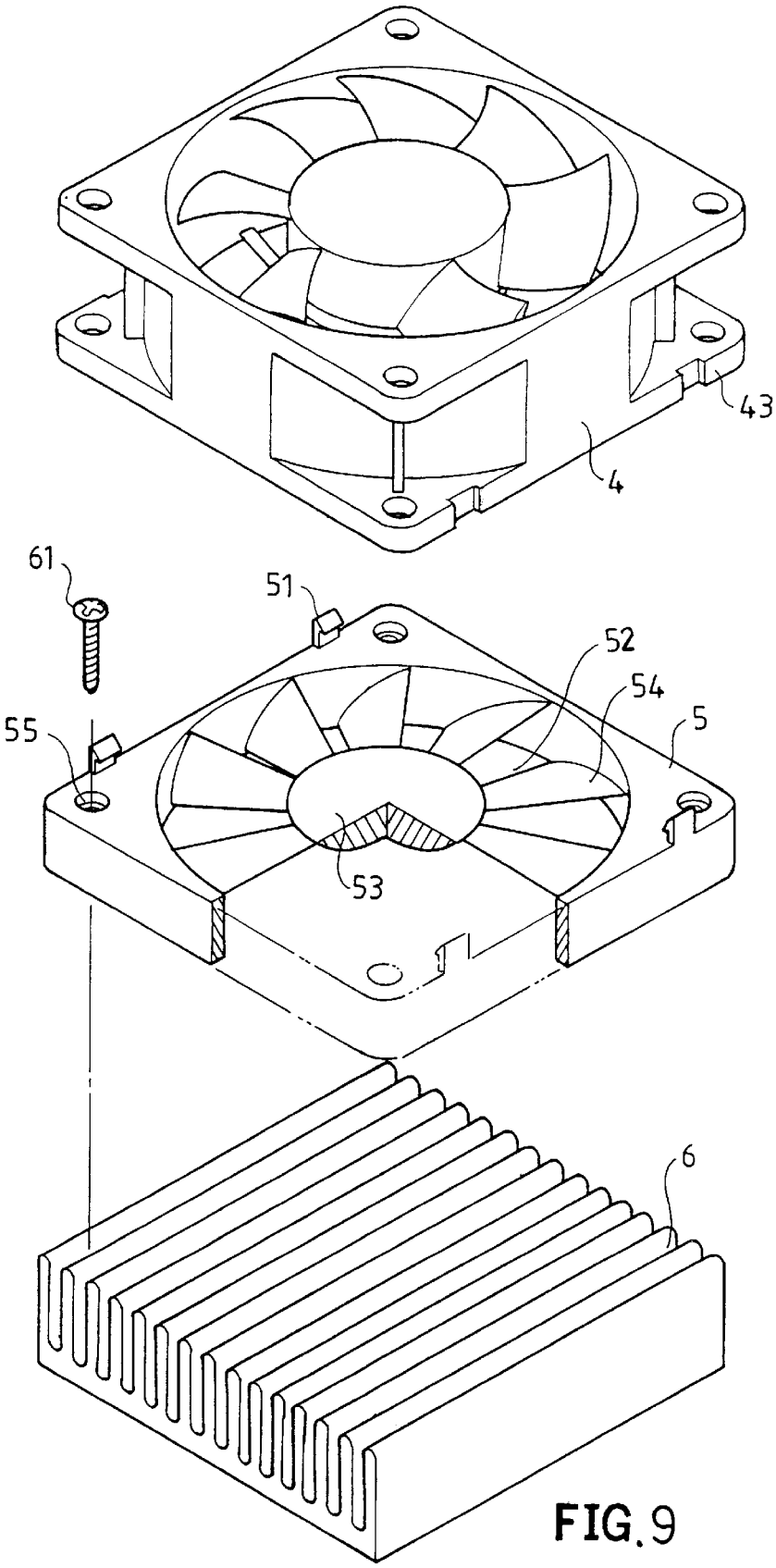
FIG. 9 is an exploded perspective view of a third embodiment of the fan in accordance with the present invention.
Figure 10:
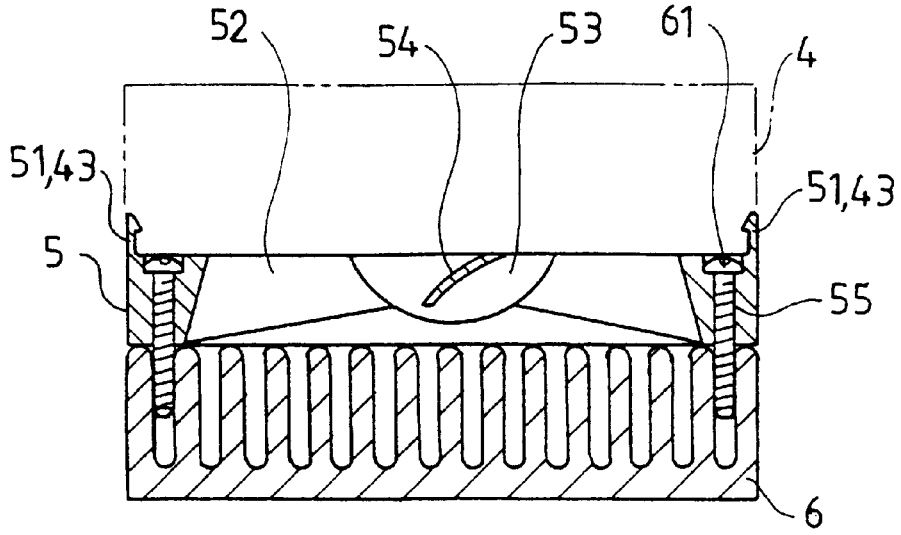
FIG. 10 is a sectional view of the fan in FIG. 9 after assembly.

FIGS. 9 and 10 illustrate engagement between the fan in accordance with the present invention and a heat-dissipating member 6. Fasteners 61 (such as bolts or the like) are extended through holes 55 in the base 5 and then engaged into the heat-dissipating member 6, thereby securing the base 5 and the heat-dissipating member 6 together. The engaging members 51 of the base 5 are hooked on the edges 43 of the casing 4 for assembly purpose.

Figure 12:
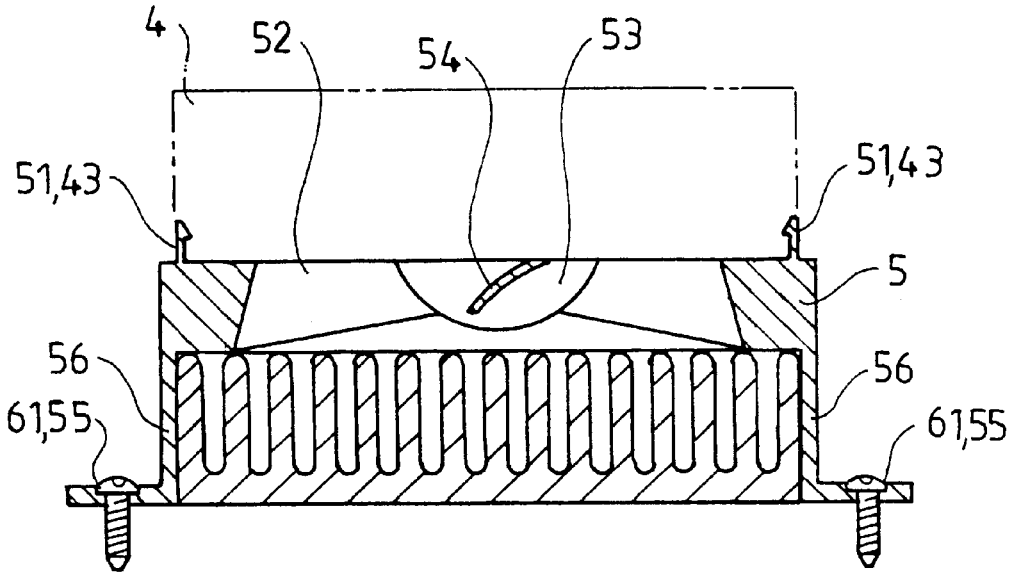
FIG. 12 is a sectional view of the fan in FIG. 11 after assembly.
Figure 11:
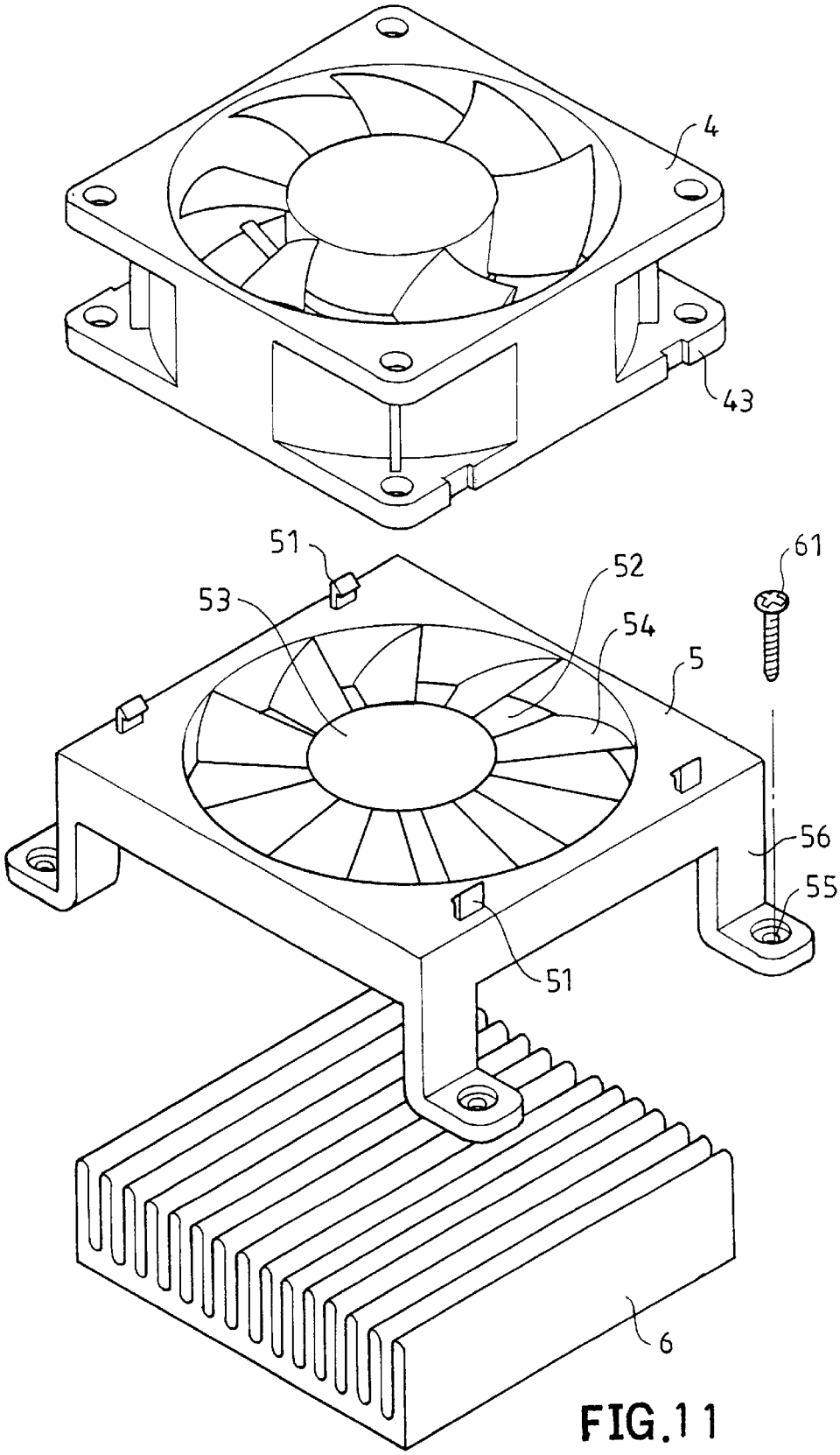
FIG. 11 is an exploded perspective view of a fourth embodiment of the fan in accordance with the present invention.

FIGS. 11 and 12 illustrate another engagement between the fan in accordance with the present invention with a heat-dissipating member 6. Plural legs 56 extend downward from the base 5 and clamp the heat-dissipating member 6. Fasteners 61 (such as bolts or the like) are extended through holes 55 in the legs 56 and then engaged into a board (not shown) on which the heat-dissipating member 6 is mounted, thereby securing the base 5 and the heat-dissipating member 6 together. The engaging members 51 of the base 5 are hooked on the edges 43 of the casing 4 for assembly purpose.

Figure 13:
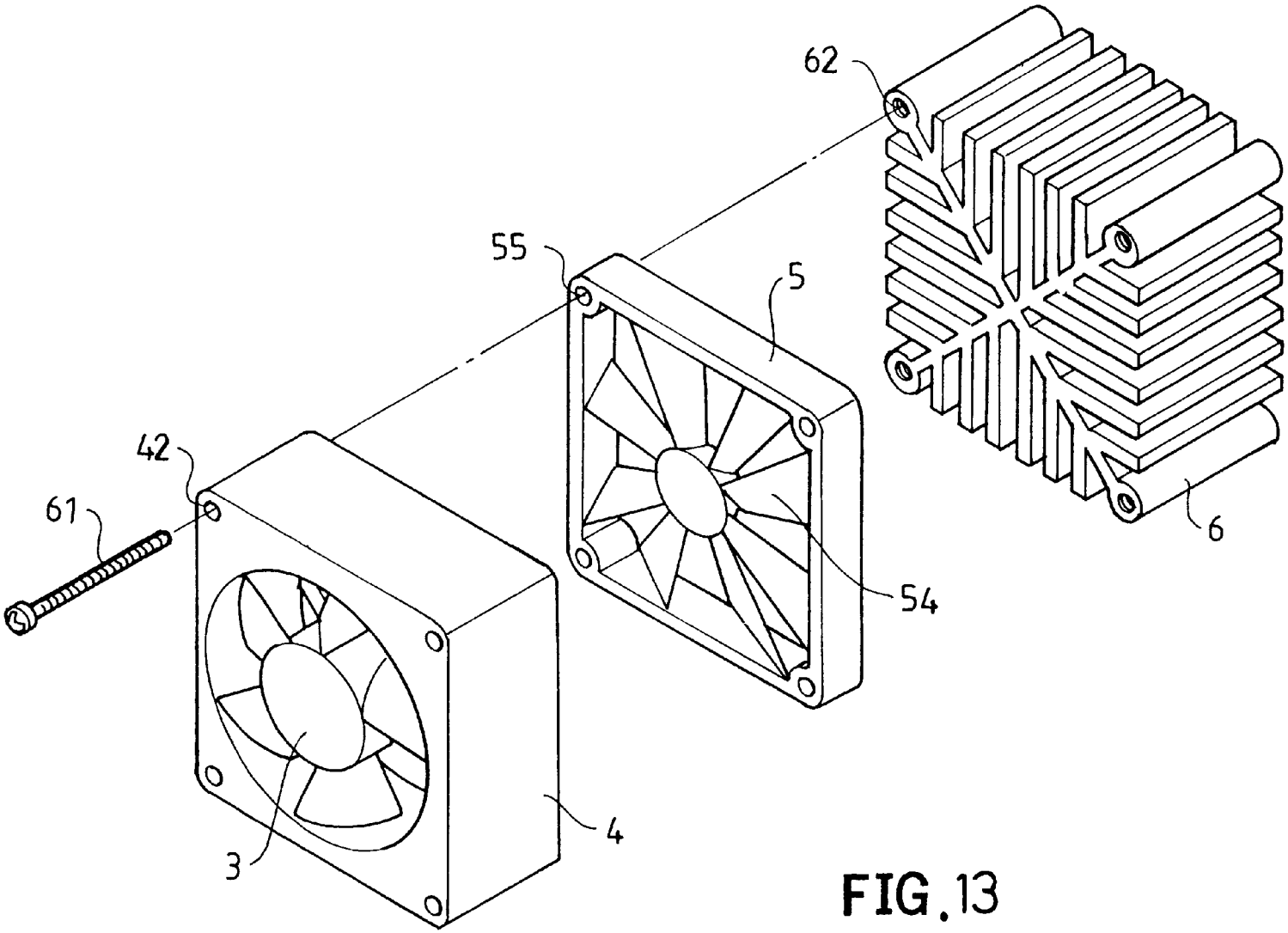
FIG. 13 is an exploded perspective view of a fifth embodiment of the fan in accordance with the present invention.

FIG. 13 illustrates a further engagement between the fan in accordance with the present invention and a heat-dissipating member 6. Fasteners 61 (such as bolts or the like) are extended through holes 42 in the casing 4, holes 55 in the base 5, and holes 62 in the heat-dissipating member 6, thereby securing the casing 4, the base 5, and the heat-dissipating member 6 together. Mounted to the casing 4 is a fan wheel 3 that can be driven to turn. The base 5 comprises plural supercharging plates 54 for supercharging the airflow when the fan wheel 3 turns to thereby provide supercharged airflow, thereby providing the heat-dissipating member 6 with improved heat-dissipating effect.

Figure 14:
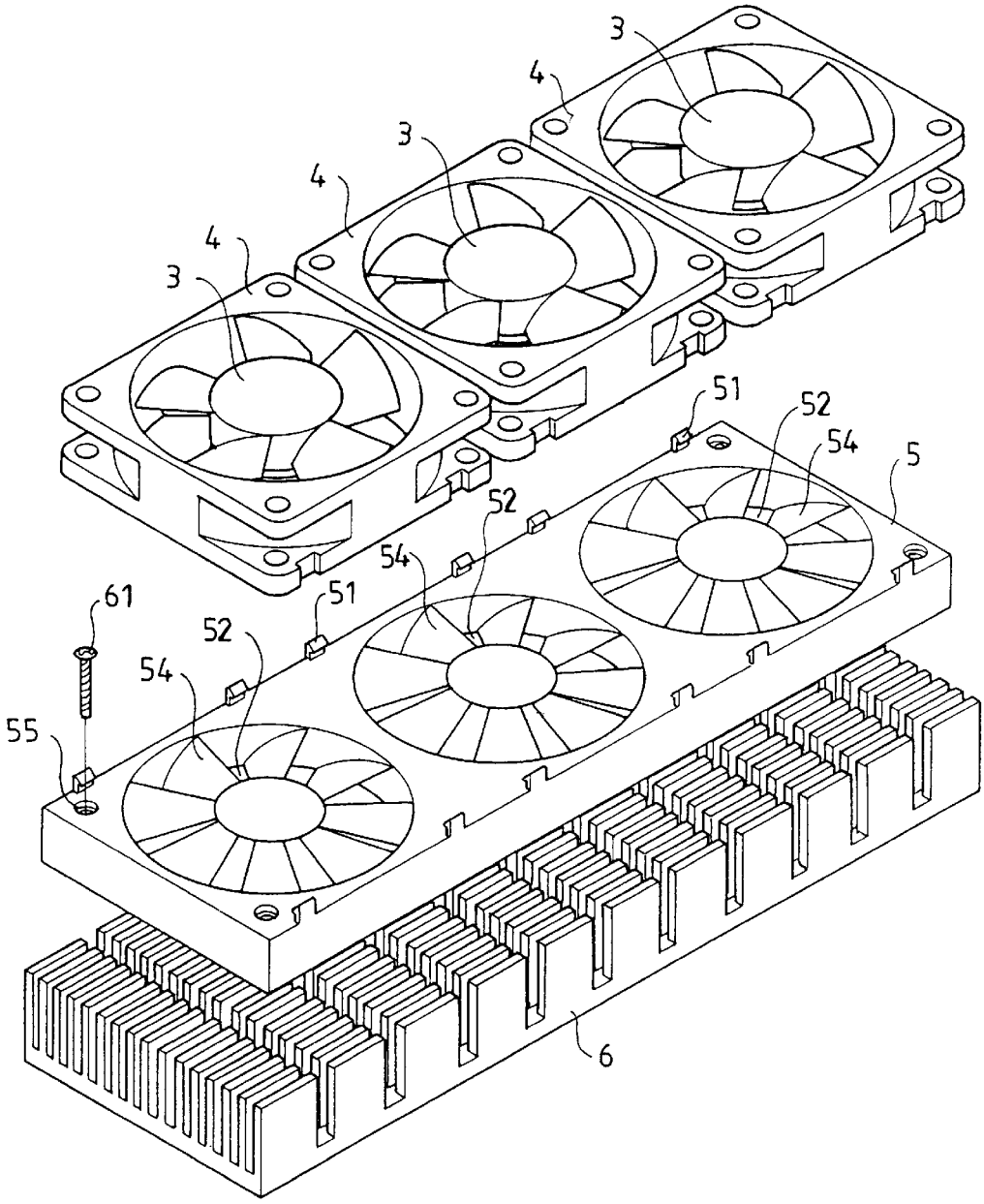
FIG. 14 is an exploded perspective view of a sixth embodiment of the fan in accordance with the present invention.

FIG. 14 illustrates still another engagement between the fan in accordance with the present invention and a heat-dissipating member 6. The base 5 is relatively long for providing plural air outlets 52 each having a set of supercharging plates 54 mounted therein. Fasteners 61 (such as bolts or the like) are extended through holes 55 in the base 5 and engaged into the heat-dissipating member 6 that is longer or thicker, thereby securing the base 5 and the heat-dissipating member 6 together. Plural casings 4 are provided, and the base 5 comprises engaging members 51 for engaging with the casings 4. Mounted to each casing 4 is a fan wheel 3 that can be driven to turn. The supercharging plates 54 of the base 5 supercharge the airflow when the fan wheels 3 turn to thereby provide supercharged airflow, thereby providing the heat-dissipating member 6 with improved heat-dissipating effect.

The fan in accordance with the present invention comprises a casing and a base that can be easily coupled to the casing. In addition, the base comprises supercharging plates for the airflow that is generated as a result of turning of the fan wheel. In addition, the fan in accordance with the present invention can be conveniently mounted to a heat-dissipating member.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A fan comprising:

a casing comprising an air passage hole, the air passage hole having an inlet at a first end thereof and an air outlet at a second end thereof, a supporting plate being supported in the air passage hole, the supporting plate having an axle tube;

a stator bobbin mounted to the axle tube of the supporting plate;

a fan wheel rotatably mounted to the stator bobbin and comprising plural blades; and a base comprising plural engaging members for coupling the base to the air outlet end of the casing, the base comprising an air outlet having a central portion, and plural supercharging plates being mounted between the central portion and the base, wherein each said supercharging plate is all inclined plate.

2. The fan as claimed in claim 1, wherein the casing comprises two opposite edges, each of the engaging members comprising a hook to be hooked on an associated one of the edges of the casing.

3. The fan as claimed in claim 2, wherein each said edge of the casing comprises plural recesses for receiving the engaging members.

4. The fan as claimed in claim 1, wherein an inner wall of the base, the inner wall defining, the air outlet of the base, is tapered at one end to form a funnel shape.

5. The fan as claimed in claim 1, wherein the casing and the base comprise aligned holes through which fasteners extend for securing the casing and the base together.

6. The fan as claimed in claim 1, wherein the base comprises plural legs extending therefrom, said legs being adapted to clamp a heat-dissipating member, each said leg including a hole.

7. The fan as claimed in claim 1, wherein each said supercharging plate has a shape as that of an axial flow blade, each said supercharging plate having an inclination direction opposite to that of blades of the fan wheel.

* * * * *